US010094089B2

(12) United States Patent
White

(10) Patent No.: US 10,094,089 B2
(45) Date of Patent: Oct. 9, 2018

(54) SOIL IMPROVEMENT FOUNDATION ISOLATION AND LOAD SPREADING SYSTEMS AND METHODS

(71) Applicant: Ingios Geotechnics, Inc., Boone, IA (US)

(72) Inventor: David J. White, Boone, IA (US)

(73) Assignee: GEOPIER FOUNDATION COMPANY, INC., Davidson, NC (US)

( * ) Notice: Subject to any disclaimer, the term of this patent is extended or adjusted under 35 U.S.C. 154(b) by 0 days.

(21) Appl. No.: 15/067,241

(22) Filed: Mar. 11, 2016

(65) Prior Publication Data

US 2016/0265184 A1 Sep. 15, 2016

Related U.S. Application Data

(60) Provisional application No. 62/132,488, filed on Mar. 12, 2015.

(51) Int. Cl.
*E02D 31/00* (2006.01)
*E02D 27/00* (2006.01)

(52) U.S. Cl.
CPC ..... *E02D 31/00* (2013.01)

(58) Field of Classification Search
CPC ..... E02D 31/00; E02D 27/00
See application file for complete search history.

(56) References Cited

U.S. PATENT DOCUMENTS 3,233,376 A * 2/1966 Naillon ..... E01F 8/0023 52/167.1
2006/0024131 A1* 2/2006 Wiegand ..... E01F 9/635 404/10

FOREIGN PATENT DOCUMENTS

JP 09158208 A 6/1997
JP 2000-054682 A * 2/2000
JP 2002356862 A 12/2002
JP 2005002552 A 1/2005
JP 2006070471 A 3/2006
JP 2011032712 A 2/2011
KR 101455327 B1 * 10/2014

OTHER PUBLICATIONS

International Search Report received in PCT/US2016/021909 dated Jul. 12, 2016.
Written Opinion received in PCT/US2016/02199 dated Jul. 12, 2016.
International Preliminary Report on Patentability issued in PCT Application PCT/US2016/021909 dated Sep. 12, 2017.

* cited by examiner

*Primary Examiner* — Tara Mayo-Pinnock

(74) *Attorney, Agent, or Firm* — Nexsen Pruet, PLLC; E. Eric Mills

(57) ABSTRACT

Systems and methods for soil improvement foundation isolation and load spreading are provided. The systems and methods provided herein relate to isolation of structural foundations from soil improvement elements and distributing stress from high stiffness elements to lower stiffness materials. A shear load transfer reduction system may include one or more ground improvement elements for supporting an applied load. A shear break element may be positioned above one or more ground improvement elements. The shear break elements may be configured to have low interface shear strength.

21 Claims, 3 Drawing Sheets

Stress Distribution with and without disk

SOIL IMPROVEMENT FOUNDATION ISOLATION AND LOAD SPREADING SYSTEMS AND METHODS

CROSS REFERENCE TO RELATED APPLICATION

This application claims priority to U.S. Provisional Patent Application No. 62/132,488, filed Mar. 12, 2015, and titled SOIL IMPROVEMENT FOUNDATION ISOLATION AND LOAD SPREADING SYSTEMS AND METHODS, the content of which is hereby incorporated herein by reference in its entirety.

TECHNICAL FIELD

The subject matter disclosed herein relates to soil improvement systems and methods. Particularly, the subject matter disclosed herein relates to systems and methods for isolation of structural foundations from soil improvement elements and distributing stress from high stiffness elements to lower stiffness covering materials.

BACKGROUND

Techniques for soil or ground improvement include soil mixing, jet grouting, stone columns, vibro concrete columns, controlled modulus columns, and aggregate pier techniques. Soil mixing and jet grouting involve the enhancement of in situ soil with cement binders. Vibro stone column techniques were developed in the 1940s in Germany. Vibro concrete columns were a later extension of traditional stone columns. Controlled modulus columns were developed in France in the 1980s. Aggregate pier techniques were developed by Nathaniel S. Fox and his coworkers in the early 1990s as described by U.S. Pat. No. 5,249,892, titled "Short Aggregate Piers and Method and Apparatus for Producing Same," and issued Oct. 5, 1993. Fox's technique involves the steps of drilling a hole in the ground, filling the hole incrementally with loose lifts of aggregate, and compacting the aggregate with a tamper head.

Fox also developed the "Impact Pier" technique which includes the steps of driving a hollow steel pipe in the ground, filling the pipe with aggregate stone, extracting the pipe in increments, and then advancing the pipe back downwards to compact the placed lift of aggregate in the ground. Advancements of the Impact technique include the use of grout or concrete, sometimes in a closed, pressurized system to construct a rigid cemented aggregate element. These aggregate or cemented-aggregate elements provide vertical support for foundations. Shortcomings exist between the interface of the rigid elements and the foundation.

These more rigid soil improvement systems including vibro concrete columns, grouted or concreted aggregate piers, controlled modulus columns, and others require an aggregate transfer pad constructed following element construction between the tops of the rigid element and the bottom of foundations. Accordingly, it is desired to provide improved techniques to enhance this critical interface and to provide other soil improvement techniques and systems.

SUMMARY

The presently disclosed subject matter provides a system and methods for reducing the shear load transferred from a structural foundation of a building to a ground improvement element. Particularly, the subject matter disclosed herein relates to systems and methods for isolation of structural foundations from soil improvement elements and distributing stress from high stiffness elements to lower stiffness covering materials.

Accordingly, in some aspects, the presently disclosed subject matter provides a shear load transfer reduction system including one or more ground improvement elements for supporting applied load. The system also includes one or more shear break elements positioned above the ground improvement elements. The shear break elements are configured to have low interface shear strength.

In other aspects, the presently disclosed subject matter provides a method for reducing shear (horizontal) load transfer. The method includes placing one or more ground improvement elements into the ground. The method also includes positioning one or more shear break elements having a low interface shear strength above the ground improvement elements. The method further comprises positioning a structural foundation above the shear break elements.

In other aspects, the presently disclosed subject matter provides a method for reducing stress concentration in the aggregate transfer pad constructed following element construction between the tops of the rigid element and the bottom of foundations.

BRIEF DESCRIPTION OF THE DRAWINGS

The present disclosure can be better understood by referring to the following figures. The components in the figures are not necessarily to scale, emphasis instead being placed upon illustrating the principles of the present disclosure. In the figures, like reference numerals designate corresponding parts throughout the different views.

DETAILED DESCRIPTION

The presently disclosed subject matter is described herein with specificity to meet statutory requirements. However, the description itself is not intended to limit the scope of this patent. Rather, the inventor has contemplated that the claimed subject matter might also be embodied in other ways, to include different steps, materials or elements similar to the ones described in this document, in conjunction with other present or future technologies. Moreover, although the term "step" may be used herein to connote different aspects of methods employed, the term should not be interpreted as implying any particular order among or between various steps herein disclosed unless and except when the order of individual steps is explicitly described.

The presently disclosed subject matter provides systems and methods for isolating friction, such as isolating the friction between ground improvement elements (also termed ground improvement inclusions or vertical inclusions) and building foundations built on top of the ground improvement elements. The presently disclosed subject matter reduces the shear loads transferred to soil improvement elements by the structures built above the elements. Specifically, the subject matter is provided to reduce the transfer of shear and lateral stresses from the structural elements to the tops of the ground improvement elements. The ground improvement elements considered in this application include any stiff vertical inclusion installed to treat the ground and support applied loads. The systems used comprise materials exhibiting low coefficients of friction to reduce the shear stress transfer.

Figures 1A, 1B:
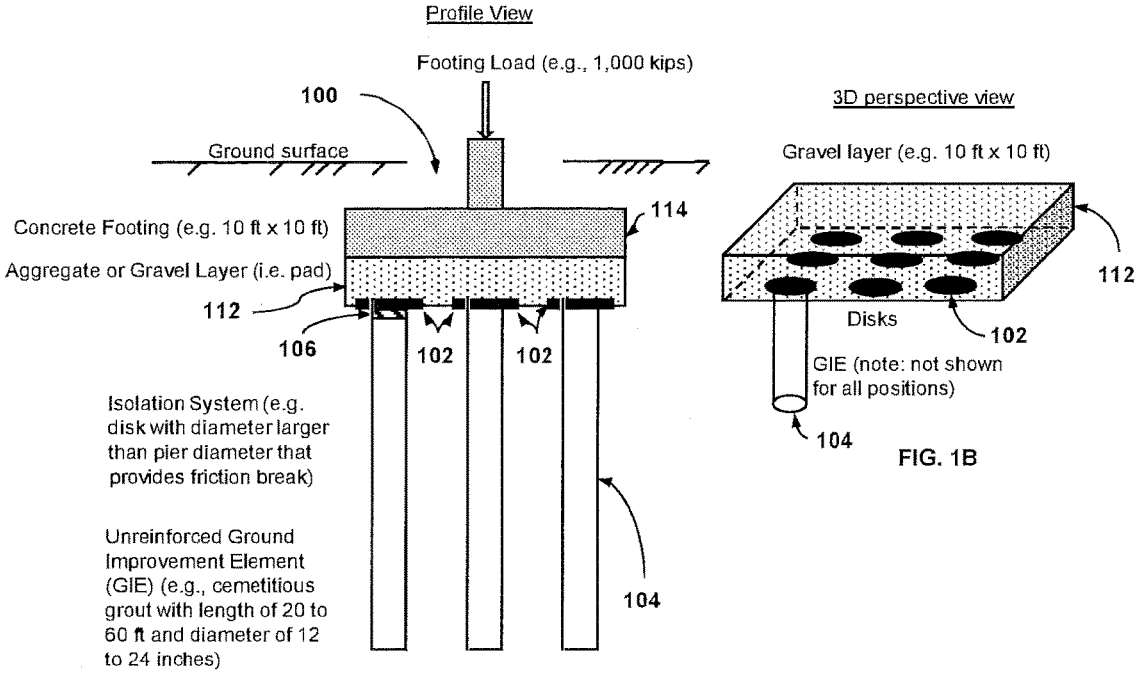
FIGS. 1A and 1B depict a cross-sectional profile view and three-dimensional view of an example soil improvement foundation isolation and load spreading system in situ in accordance with embodiments of the present disclosure.

FIGS. 1A and 1B illustrate a cross-sectional view of an example soil improvement foundation isolation and load spreading system 100 in situ in accordance with embodiments of the present disclosure. Referring to FIGS. 1A and 1B, the system 100 may be used for reducing the shear load transferred from a structural foundation of a building to a ground improvement element. The system 100 may include one or more shear break element 102 positioned above a ground improvement element 104. The shear break element 102 may exhibit a low interface shear strength.

Materials comprising the presently disclosed shear break elements 102 exhibiting "low interface shear strength" as used herein refer to materials with low friction angles and low values of interface cohesion. Non-limiting examples include, but are not limited to, high density polyethylene (HDPE), poly(vinyl chloride) (PVC), polypropylene, polished metal, ceramic materials, fiberglass, composite materials with low friction angle, smooth aggregate with low friction angle, particulates with low friction angles, and the like. In some embodiments, at least one shear break element 102 comprises a plastic material. In other embodiments, at least one shear break element 102 comprises material selected from the group consisting of high density polyethylene (HDPE), poly(vinyl chloride) (PVC), and polypropylene.

Figures 2A, 2B:
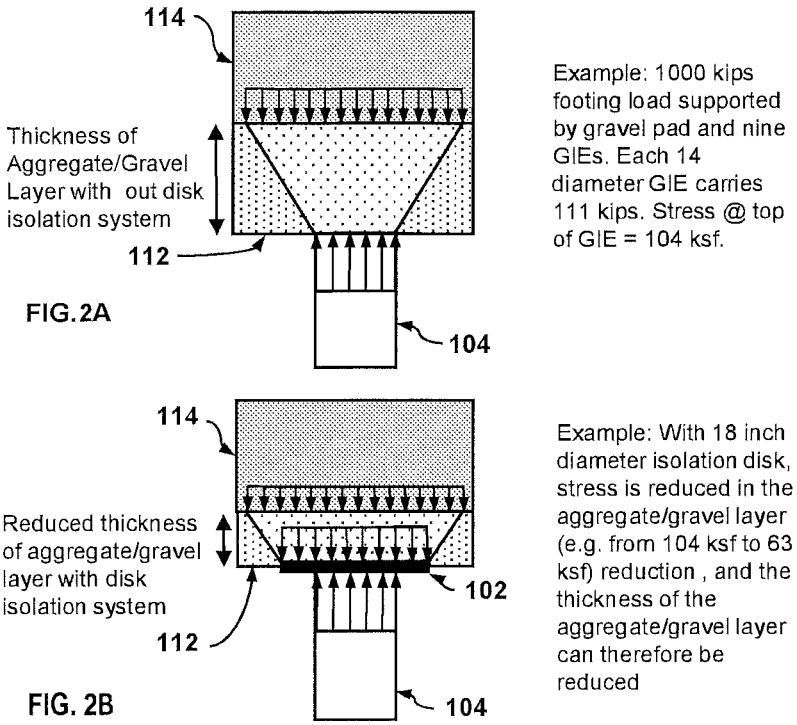
FIGS. 2A and 2B depict a cross-sectional view of an example soil improvement foundation isolation and load spreading system that depicts calculated stresses in accordance with embodiments of the present disclosure.

FIGS. 2A AND 2B illustrate a cross-sectional view of an example soil improvement foundation isolation and load spreading system that depicts calculated stresses (with and without the shear break element) in accordance with embodiments of the present disclosure. In some embodiments, at least one shear break element 102 may be substantially circular. In FIG. 2B, a shear break element 102 disc of 18 inches is shown. As a non-limiting example, it may be desired the diameter of a shear break element 102 can range from about 6 inches to more than about 48 inches. It is noted the diameter of the shear break elements may be either smaller or larger than this range.

In some embodiments, the presently disclosed system may include a granular bedding material 106 placed in between the ground improvement element 104 and one or more shear break elements 102. In other embodiments, the bedding material 106 may include, but is not limited to, sand, aggregate, other soil materials, slag, and the like. In other embodiments, the bedding material 106 may be include sand, aggregate, slag, the like, and combinations thereof.

Figure 3:
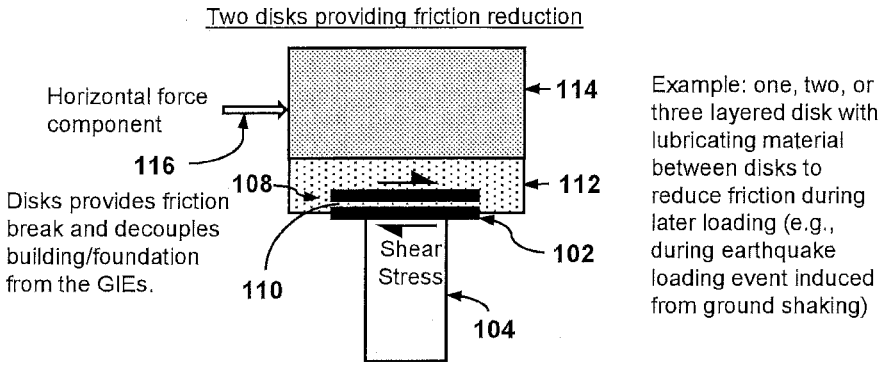
FIG. 3 is a cross-sectional view of an example soil improvement foundation isolation and load spreading system that shows shear break elements to decouple a building from the ground improvement elements in accordance with embodiments of the present disclosure.

FIG. 3 illustrates a cross-sectional view of an example soil improvement foundation isolation and load spreading system that shows shear break elements 102 to decouple a building from the ground improvement elements 104 in accordance with embodiments of the present disclosure. In some embodiments, the presently disclosed system 100 may include a viscous lubricant 110 placed between two or more shear break elements 102. In other embodiments, the viscous lubricant 110 may include, but is not limited to, hydraulic oil, automotive grease, biologically-derived lubricant, the like, and combinations thereof. In other embodiments, the uppermost shear break element 102 may include a raised perimeter edge to contain and confine overlying filling materials 112.

The number of shear break elements 102 in the presently disclosed system 100 can vary from 1 to more than 1, such as 2, 3, 4, 5, or more. In some embodiments, two shear break elements 102 are placed on top of the ground improvement element 104.

Figure 4:
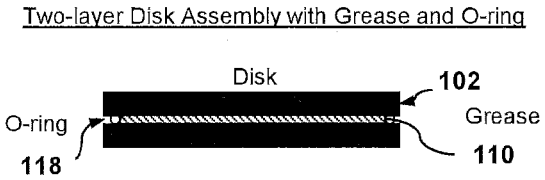
FIG. 4 is a cross-sectional view that shows a two-layer shear break element in accordance with embodiments of the present disclosure.

FIG. 4 illustrated a two-layer shear break element with a lubricant 110 and a rubber O-ring 118.

In some embodiments, the presently disclosed subject matter includes an example method for constructing the presently disclosed system 100 to reduce the shear load transferred from a structural foundation of a building to a ground improvement element 104. The method includes placing the ground improvement element 104 into the ground. The method also includes placing one or more shear break elements 102 exhibiting a low interface shear strength for a high axial stiffness on top of the ground improvement element 104. The method also includes building the structural foundation of the building on top of the at least one shear break element 102.

In other embodiments, an example method may include excavating the area around the ground improvement element 104 to expose the ground improvement element 104 and the soil around the ground improvement element 104 prior to placing the shear break elements 102 on top of the ground improvement element 104.

In other embodiments, example methods include filling in the excavated area with a solid material 112 before building the structural foundation of the building on top of the shear break elements 102.

In further embodiments, the solid material 112 may include, but is not limited to, aggregate, sand, slag, earthen materials, the like, and combinations thereof. In other examples, the solid material 112 may include aggregate.

In some embodiments, bedding material 106 may be placed between the ground improvement element 104 and shear break elements 102. In other embodiments, a viscous lubricant 110 may be placed on top of at least one shear break element 102. In still other embodiments, two shear break elements 102 may be placed on top of the ground improvement element 104.

In some embodiments, the system includes two or more separate sections 108 of a material exhibiting a low coefficient of friction. In other embodiments, the sections are of sufficient thickness to avoid cracking or extensive deformation when subjected to the applied stresses over the ground improvement inclusion. While circular in shape is the preferred embodiment, alternate shapes including square, oval, and rectangular are also envisioned. In still other embodiments, shapes may extend at least to the edge of ground improvement inclusion in some or all directions. In further embodiments, the shapes may extend beyond the edge of the ground improvement elements 104.

In some embodiments, an excavation may be made following construction of the ground improvement inclusion and prior to placement of footing 114 concrete. The excavation may expose both soil and ground improvement inclusions. In other embodiments, one shear break element may be placed over the top of each of the inclusions. In an example, a thin layer of bedding material 106 may be placed over the top of the inclusion prior to shear break element 102 placement to create a more level surface and cushion. Also, a layer of viscous lubricant 110 may be placed between two shear break elements. In still other embodiments, a second shear break element 102 of similar shape and size is placed over top of the first. In further embodiments, the remainder of the footing excavation is filled with aggregate extending at least above the height of the top of the first plate. In still other embodiments, the concrete footing 114 may subsequently be constructed over the top of the backfilled excavation.

In some embodiments, the presently disclosed system and methods allow reduction of the lateral load resistance (or reduction of the shear loads transferred to ground improvement elements 104) by any amount. It may be desired to reduce the lateral load resistance by at least between about 10% to about 80%. In other embodiments, the reduction of the shear loads transferred to ground improvement elements by the structures built above the elements 104 may be at least about 50%.

This system and method will allow for horizontal movement 116 of the foundation when subjected to horizontal loads 116 without direct transfer of lateral and shear stresses to the ground improvement inclusions thereby maintaining their integrity and support characteristics under a dynamic event.

In some embodiments, the system extends beyond the edge of the ground improvement elements 104 with oversized sections of a material exhibiting sufficient stiffness to reduce stress concentration in the aggregate transfer pad.

In an example, a ground improvement inclusion measuring between 14-inches and 20-inches in diameter is considered. The ground improvement inclusion is constructed from either aggregate contained within a cementitious grout or concrete. The inclusion is constructed such that the top bears within 3 inches of the planned footing bottom. The solid shear break elements 102 are constructed from high density polyethylene (HDPE) and are cylindrical. Each element measures 21 to 30 inches in diameter and between ¼-inch and ½-inch in thickness. A lubricating layer 110 of hydraulic oil or automotive grease is used to further reduce the frictional resistance at the shear break interface. A bedding layer 106 of fine sand is placed over the top of the inclusion followed by the placement of the first shear break plate. The lubricant 110 may be applied followed by the placement of the second plate of similar size over the lubricant 110.

The system and method are evaluated through a series of comparative load tests with a control group and the proposed system and method. The control features a 14-inch diameter concrete inclusion surrounded by soil. A concrete footing 114 is placed over top. A second control features the 14-inch diameter concrete inclusion surrounded by soil, followed by placement of a 9-inch thick aggregate layer over the entire area. A setup for testing of this system and method includes a 14-inch diameter concrete inclusion surrounded by soil, followed by the system described herein. In all test cases, a concrete footing 114 of consistent size was used.

The test was performed by applying a constant vertical load by use of a hydraulic jack and a reaction frame. A horizontal load 116 is applied and lateral deflections are measured. The validity of the shear break device is confirmed by the reduction of the lateral load resistance between the two controls and the test case by at least 30%.

Although the foregoing subject matter has been described in some detail by way of illustration and example for purposes of clarity of understanding, it will be understood by those skilled in the art that certain changes and modifications can be practiced within the scope of the appended claims.

What is claimed is:

1. A shear load transfer reduction system comprising:

at least one ground improvement element for supporting applied loads;

at least one shear break element positioned above the at least one ground improvement element, wherein the at least one shear break element comprises a plastic material and is configured to have low interface shear strength; and a granular bedding material, wherein the granular bedding material is placed between the at least one ground improvement element and the at least one shear break element.

2. The system of claim 1, wherein the plastic material is selected from the group consisting of high density polyethylene (HDPE), poly(vinyl chloride) (PVC), and polypropylene.

3. The system of claim 1, wherein the at least one shear break element is substantially circular.

4. The system of claim 3, wherein the diameter of the at least one shear break element ranges from 6 inches to 48 inches.

5. The system of claim 1, wherein the granular bedding material is selected from the group consisting of sand, aggregate, and slag.

6. The system of claim 1, further comprising a viscous lubricant placed between at least two shear break elements.

7. The system of claim 6, wherein the viscous lubricant is selected from the group consisting of hydraulic oil and automotive grease.

8. The system of claim 1, wherein two shear break elements are positioned above the at least one ground improvement element.

9. A method for reducing shear load transfer, the method comprising:

placing at least one ground improvement element into the ground;

positioning at least one shear break element having a low interface shear strength above the at least one ground improvement element, wherein the at least one shear break element comprises a plastic material;

positioning a structural foundation above the at least one shear break element; and positioning a granular bedding material between the at least one ground improvement element and the at least one shear break element.

10. The method of claim 9, further comprising excavating an area surrounding the at least one ground improvement element to expose the at least one ground improvement element and the soil within the area.

11. The method of claim 10, further comprising filling in the excavated area using a solid material before positioning the structural foundation above the at least one shear break element.

12. The method of claim 11, wherein the solid material comprises aggregate.

13. The method of claim 9, wherein the plastic material is selected from the group consisting of high density polyethylene (HDPE), poly(vinyl chloride) (PVC), and polypropylene.

14. The method of claim 9, wherein the at least one shear break element is substantially circular.

15. The method of claim 14, wherein the diameter of the at least one shear break element ranges from 6 inches to 48 inches.

16. The method of claim 9, wherein the granular bedding material is selected from the group consisting of sand, aggregate, and slag.

17. The method of claim 9, further comprising placing a viscous lubricant between at least two shear break elements.

18. The method of claim 17, wherein the viscous lubricant is selected from the group consisting of hydraulic oil and automotive grease.

19. The method of claim 9, wherein two shear break elements are placed on top of the ground improvement element.

20. A shear load transfer reduction system comprising:

at least one ground improvement element for supporting applied loads;

two shear break elements positioned above the at least one ground improvement element, wherein the two shear break elements are configured to have low interface shear strength; and a granular bedding material, wherein the granular bedding material is placed between the at least one ground improvement element and the two shear break elements.

21. A method for reducing shear load transfer, the method comprising:

placing at least one ground improvement element into the ground;

positioning two shear break elements having a low interface shear strength above the at least one ground improvement element;

positioning a structural foundation above the two shear break elements; and positioning a granular bedding material between the at least one ground improvement element and the two shear break elements.

* * * * *